US006518883B1

(12) United States Patent
Benard et al.

(10) Patent No.: US 6,518,883 B1
(45) **Date of Patent: *Feb. 11, 2003**

(54) SAFETY SYSTEM FOR MOTOR VEHICLE OPENING PANEL

(75) Inventors: Thierry Benard, Paris (FR); Luc Josserand, Turin (FR)

(73) Assignee: Valeo Securite Habitacle, Creteil (FR)

( * ) Notice: Subject to any disclaimer, the term of this patent is extended or adjusted under 35 U.S.C. 154(b) by 0 days.

This patent is subject to a terminal disclaimer.

(21) Appl. No.: 09/857,941

(22) PCT Filed: Oct. 10, 2000

(86) PCT No.: PCT/FR00/02803

§ 371 (c)(1),
(2), (4) Date: Jun. 12, 2001

(87) PCT Pub. No.: WO01/27419

PCT Pub. Date: Apr. 19, 2001

(30) Foreign Application Priority Data

Oct. 12, 1999 (FR) ..... 99 12674

(51) Int. Cl.[7] ..... E05B 45/06

(52) U.S. Cl. ..... 340/542; 340/426; 340/556; 307/10.2

(58) Field of Search ..... 340/542, 426, 340/545.6, 545.7, 567, 556; 70/257; 307/10.2

(56) References Cited

U.S. PATENT DOCUMENTS

| | | | | |
|---|---|---|---|---|
| 5,497,641 A | * | 3/1996 | Linde et al. | 70/257 |
| 5,682,135 A | * | 10/1997 | Lobonde | 340/426 |
| 6,239,693 B1 | * | 5/2000 | Benard et al. | 340/426 |
| 6,093,978 A | * | 7/2000 | Benard et al. | 307/10.2 |
| 6,218,933 B1 | * | 4/2001 | Josserand et al. | 340/426 |

FOREIGN PATENT DOCUMENTS

| | | |
|---|---|---|
| DE | 19817587 | 2/1999 |
| EP | 0903453 | 3/1999 |
| FR | 2772818 | 6/1999 |

* cited by examiner

*Primary Examiner*—Daniel J. Wu
*Assistant Examiner*—Phung Nguyen
(74) *Attorney, Agent, or Firm*—Liniak, Berenato & White

(57) ABSTRACT

A safety system wherein the cover (48) is maintained axially in the body panel window by an inner elastically deformable ring (70) carrier by the tubular skirt (52), and enables the cover (48) to be mounted axially from outside inwards by being elastically interlocked.

9 Claims, 3 Drawing Sheets

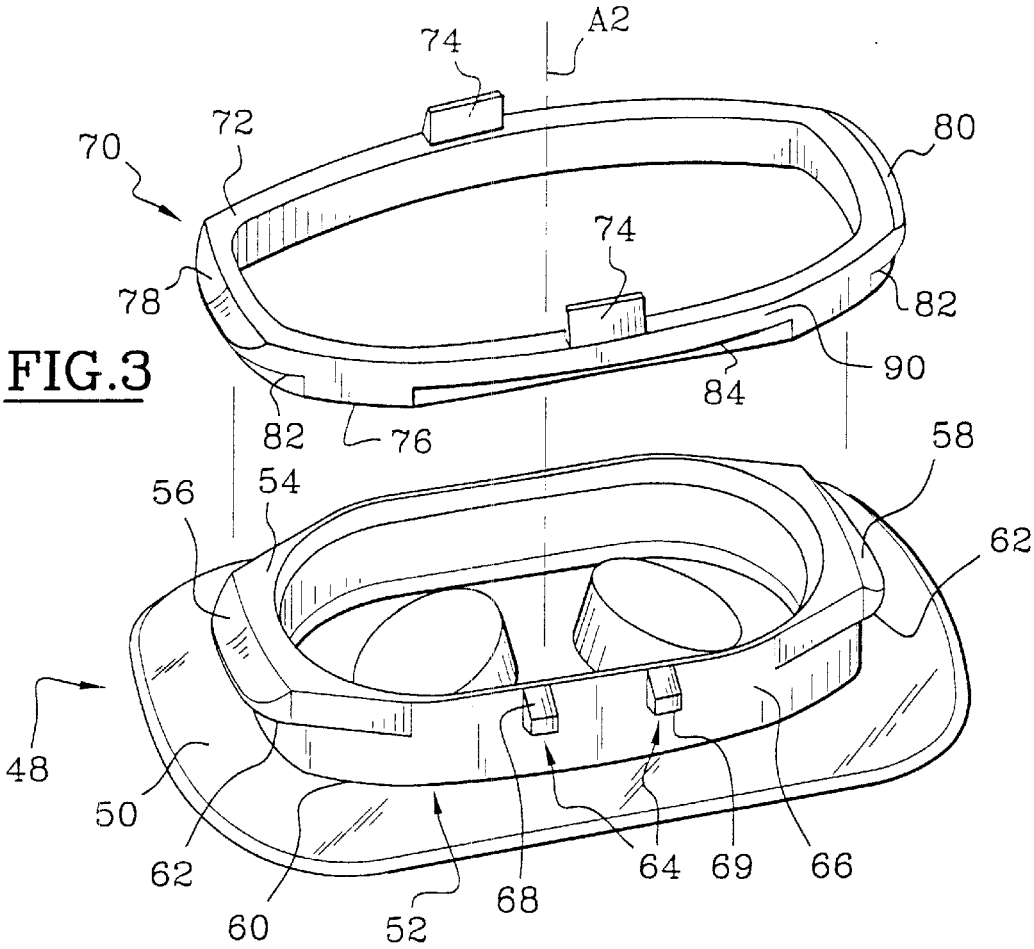
FIG.3
FIG.2
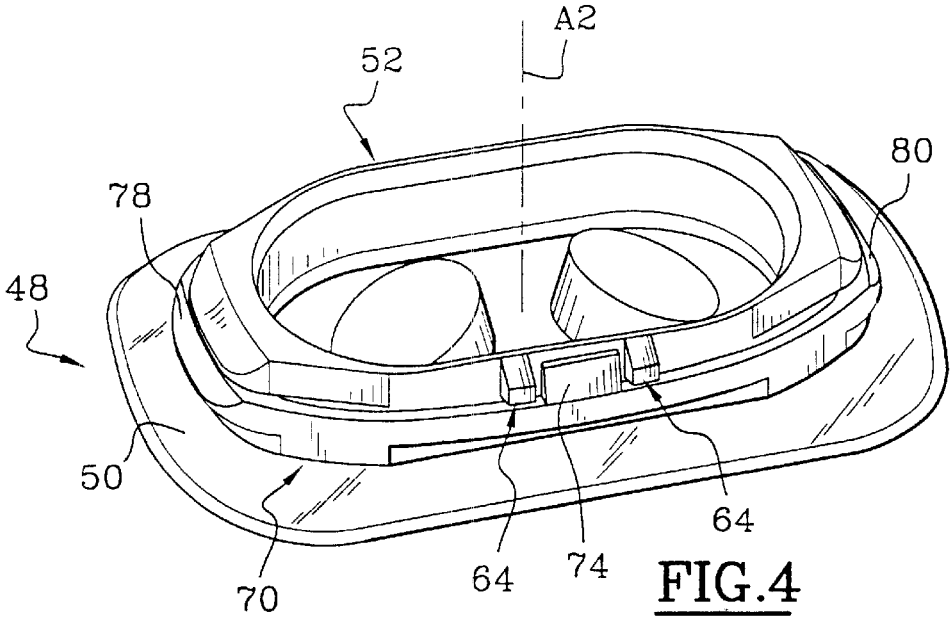
FIG.4

SAFETY SYSTEM FOR MOTOR VEHICLE OPENING PANEL

The invention relates to a security system for an opening leaf of a motor vehicle.

The invention relates more specifically to a security system for an opening leaf of a motor vehicle, of the type in which the opening leaf is held in the closed position by a lock which is operated by means of a handle arranged on the outer face of a bodywork panel of the opening leaf, of the type in which the security system comprises means for detecting the presence of a user's hand near the handle that comprise:

a sensor capable of emitting or receiving a signal, such as an electromagnetic signal; and a module that supports the sensor and that is located on the inner face of the bodywork panel in such a way that the sensor faces an opening made in the bodywork panel, of the type in which the opening in the bodywork panel is blanked off by a cover that is made of a material transparent to the signal, and of the type in which the cover comprises an annular outer peripheral wall pressed axially against the outer face of the bodywork panel, and a tubular skirt that extends inward axially from the outer peripheral wall, through the opening in the bodywork panel.

More specifically, it is an object of the invention to propose a configuration of the cover that facilitates the fitting of the system to the opening leaf, allowing the cost of performing this operation to be reduced, while at the same time guaranteeing that the fitting and the system are reliable, particularly by achieving a good seal to prevent dust or moisture from being able to disrupt the operation of the system.

To this end, the invention proposes a security system of the type described above, characterized in that the cover is retained axially in the opening of the bodywork panel by means of an elastically deformable inner ring that is mounted on the tubular skirt and enables the cover to be fitted axially from the outside in by elastic push-fitting.

In accordance with other features of the invention:

the ring comprises, on its inward transverse face, at least one surface forming a ramp to bring about its radial deformation by acting on the edge of the opening, when the cover is being fitted into the opening, and the ring comprises an outward transverse face that defines an axial-limit surface, which faces the inner face of the bodywork panel when the cover is in the fitted position in the opening;

the tubular skirt comprises on its inward transverse face at least one surface forming a ramp to bring about the radial deformation of the ring by acting on the edge of the outward transverse face of the ring, and the tubular skirt comprises an outward transverse face that defines an axial-limit surface, which faces the inward transverse face of the ring when the ring is in the fitted position on the tubular skirt;

each of the ring and the tubular skirt comprises a ramp on each of the portions at the radial extremities of its inward transverse face;

each of the ring and the tubular skirt comprises an axial-limit surface on each of the portions at the radial extremities, and/or on each of the sides, of its outward transverse face;

the ring comprises, on its inward transverse face, at least one retaining tab that extends inward axially, and the tubular skirt comprises at least two stop studs that project from its peripheral lateral face and that sit either side of the retaining tab in order to index the ring in angular terms relative to the tubular skirt;

the stop studs comprise a surface forming a ramp to bring about the radial deformation of the ring by acting on the edge of the outward transverse face of the ring;

the ring is made of a natural or synthetic elastomeric material;

a peripheral seal, which is compressed axially when fitted, exerts an outward axial bearing force on the inward transverse face of the tubular skirt.

Other features and advantages of the invention will become apparent on reading the following detailed description, for an understanding of which reference should be made to the accompanying drawings, in which:

FIG. 2 is a perspective view showing a cover in accordance with the teachings of the invention prior to fitting the retaining ring on the cover;

FIG. 3 is a perspective view showing a retaining ring in accordance with the teachings of the invention prior to being fitted on the cover;

FIG. 4 is a perspective view showing the ring seen in FIG. 3 in the fitted position on the cover seen in FIG. 2;

FIG. 1 illustrates a motor vehicle security system 10 whose general design is known and which comprises a handle for an opening leaf of a motor vehicle, the handle being designed to be mounted on an outer bodywork panel 12 of the opening leaf.

Figure 1:
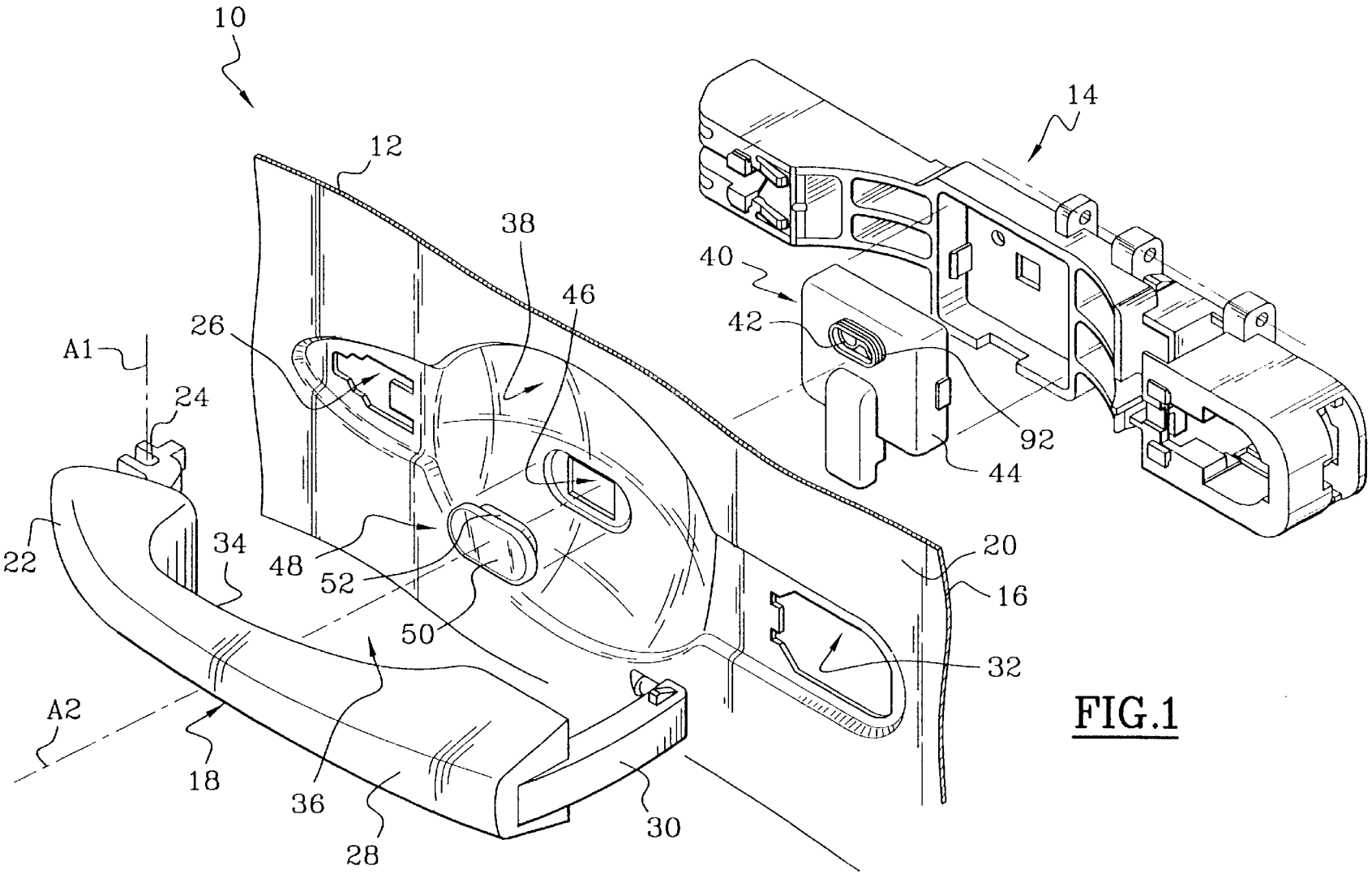
FIG. 1 is an exploded perspective view of the principal components of a security system for an opening leaf of a motor vehicle in accordance with the teachings of the invention.

The handle essentially comprises a handle mounting 14 which is fixed on an inner face 16 of the panel 12, and a handle lever 18 which is arranged on the outer face 20 of the panel 12 and is hinged to the mounting 14, about an axis A1 which is generally parallel to a general plane of the panel 12. The direction of the axis A1 will be arbitrarily described as vertical, while the direction perpendicular to the axis A1 and perpendicular to the general plane of the panel 12, will be described as the axial direction following the axis A2 along which the components of the handle are fitted to the panel 12.

To allow the handle lever 18 to pivot, the front end 22 of the lever 18, which is essentially in the form of a bar of transverse orientation, comprises a projection 24 designed to be engaged through a forward orifice 26 in the bodywork panel 12, in order to be mounted rotatably on the mounting 14.

The rear end 28 of the handle lever 16 [sic] comprises a rear foot 30 that extends axially in through a rear orifice 32 made in the panel 12 in such a way as to engage with a linkage (not shown).

A user can thus operate the handle lever 18 by grasping a part roughly in the center of the lever 18 and pulling it axially out from a rest position to an open position. This action causes the lever 18 to rotate about the axis A1.

To move the handle lever 18 toward its open position, the user of the vehicle must therefore introduce his or her hand between the bodywork panel 12 and a surface 34 of the lever 18 in order to be able to pull it towards him or herself, away from the panel 12. For this purpose a space 36 is provided between the panel 12 and the lever 18, which, in a plane perpendicular to the axis A1, is bounded axially by an inward depression 38 of the panel 12 and by the surface 34 of the lever 18, which are opposite each other.

The security system comprises a detection device 40 which detects the presence of the user's hand in the space 36 before the hand has actually grasped the lever 18 by its surface 34, and which is mounted on the handle mounting 14 arranged on the inner face of the panel 12.

More specifically, the detection device 40 comprises in part a sensor 42 which is mounted on the outward transverse face of a casing 44, which is itself fixed to the handle mounting 14. The sensor 42 is connected to an electronic control module (not shown) which is located inside the casing 44.

In the example of an embodiment illustrated, the sensor 42 emits and receives a signal of electromagnetic type. The signal is emitted and follows a trajectory which extends across the space 36 in such a way that, when the user's hand enters this space 36, it necessarily intercepts the trajectory of the signal and prevents the sensor 42 from receiving the signal. A data item is deduced from this concerning the presence of the hand in this space 36.

The signal emitted by the sensor 42 is, for example, a light signal in the infrared range. The sensor 42 is situated in line with an opening 46 which is cut into the depression 38 of the bodywork panel 12. The signal emitted by the sensor 42 is directed out through the opening 46 of the panel 12. In the absence of a hand, the signal is reflected by a portion of the surface 34 of the lever 16 [sic] which sends the signal back toward the sensor 42, passing again through the opening 46.

The opening 46 in the bodywork panel 12 is designed to be blanked off by a cover 48 with an annular outer peripheral wall 50 that extends generally parallel to the bodywork panel 12, on the outside of it. The cover 48 is of course made of a material that is transparent to the electromagnetic signal.

The cover 48 comprises a tubular skirt 52 that extends axially in from the annular outer peripheral wall 50 through the opening 46 of the panel 12.

In the present case the cover 48 is generally oval in cross section. It comprises two rounded radial extremities and generally straight sides.

In alternative forms (not shown) of the invention, the cover is of another shape, e.g. rectangular or circular.

In the remainder of the description, referring to FIGS. 2 to 4, the cover 48 has been shown with its tubular skirt 52 situated above its annular outer peripheral wall 50. The radial extremities are situated generally on the left and right of the figures.

Illustrated in FIG. 2 is a perspective view of the cover 48. In accordance with the teachings of the invention, the tubular skirt 52 comprises, on its inward transverse face 54, surfaces 56, 58 forming ramps at each of its radial extremities, in the present case on the left and right, respectively, of the figure.

The tubular skirt 52 also comprises an outward transverse face 60 that defines axial-limit surfaces 62. In the present case these axial-limit surfaces 62 are situated under the surfaces 56, 58 that form ramps.

The tubular skirt 52 also comprises stop studs 64 projecting from its peripheral lateral face 66. Visible in FIG. 2 are the two studs 64 which are situated on one side of the tubular skirt 52. Two stop studs 64 are situated symmetrically on the other side but are not visible in FIG. 2.

The stop studs 64 also comprise on their inward transverse face a surface 68 forming a ramp, and on their outward transverse face a limit surface 69.

FIG. 3 shows a perspective view of the ring 70 prior to fitting and FIG. 4 shows a perspective view of the ring 70 in the fitted position on the tubular skirt 52.

In accordance with the teachings of the invention, the ring 70 comprises on its inward transverse face 72 two retaining tabs 74 that extend axially inward.

The ring 70 is fitted on the tubular skirt 52 in an outward direction along the fitting axis A2. During fitting, the internal edge of the outward transverse face 76 of the ring 70 is acted upon by the ramp surfaces 56, 58, 68 in such a way that the ring 70 deforms elastically, stretching radially at these ramps. As soon as the ring 70 is axially past the ramps, it returns to its initial shape, thus being push-fitted elastically onto the tubular skirt 52.

When the ring 70 is in the fitted position on the tubular skirt 52, its inward transverse face 72 is next to the limit surfaces 62, 69 on the tubular skirt 52, which prevents the ring 70 from moving axially.

As can be seen in FIG. 4, each retaining tab 74 is designed to be inserted into the space formed between the two stop studs 64 situated on one side of the tubular skirt 52. The stop studs 64 thus oppose the circumferential angular movements of the ring 70 when in the fitted position on the tubular skirt 52.

In accordance with the teachings of the invention, the ring 70 comprises, on its inward transverse face 72, surfaces 78, 80 that form ramps at each of its radial extremities, in the present case on the left and right of FIG. 3.

The outward transverse face 76 defines axial-limit surfaces 82, 84 at the radial extremities and on the sides, respectively, of the ring 70.

Figure 5A:
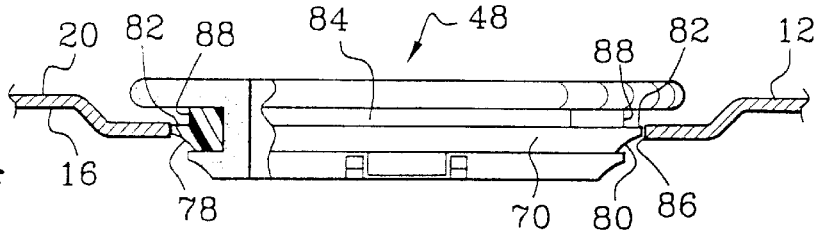
FIG. 5A is a side view of the cover seen in FIG. 4 shown in an intermediate position during fitting into the opening of the bodywork panel of the opening leaf.

To explain the fitting of the cover 48 equipped with the ring 70 in the opening 46, reference will now be made to FIGS. 5A and 5B which show the cover 48 in an intermediate position during fitting, and to FIGS. 6A and 6B which show the cover 48 in the fitted position.

The cover 48 is fitted in the opening 46 in an inward direction along the fitting axis A2. During the fitting operation, as the cover 48 is moved axially in, the ramp surfaces 78, 80 are acted upon by the edge 86 of the opening 46 in such a way that the ring 70 is deformed radially, becoming compressed at the ramps, as can be seen in figures 5A and 5B. The radial extremities of the ring 70 are now pressing radially against the edge 86 of the opening 46, and the cover 48 is in the intermediate position in the course of fitting.

Figure 5B:
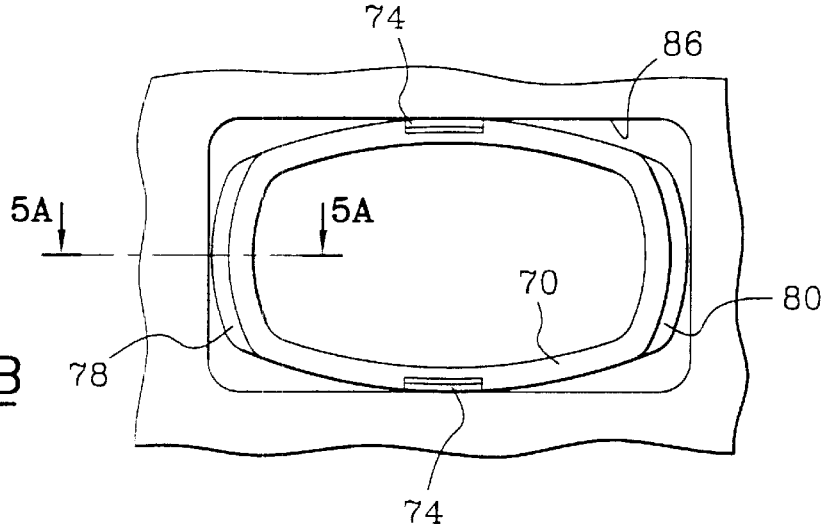
FIG. 5B is a diagram illustrating in front view the ring in the intermediate fitting position seen in FIG. 5A.
Figure 6A:
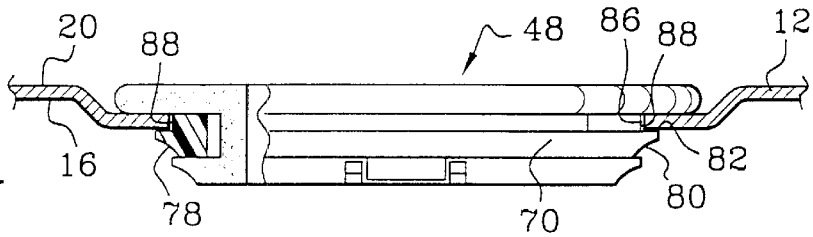
FIG. 6A is a side view of the cover seen in FIG. 4. shown in its fitted position in the opening of the bodywork panel of the opening leaf.
Figure 6B:
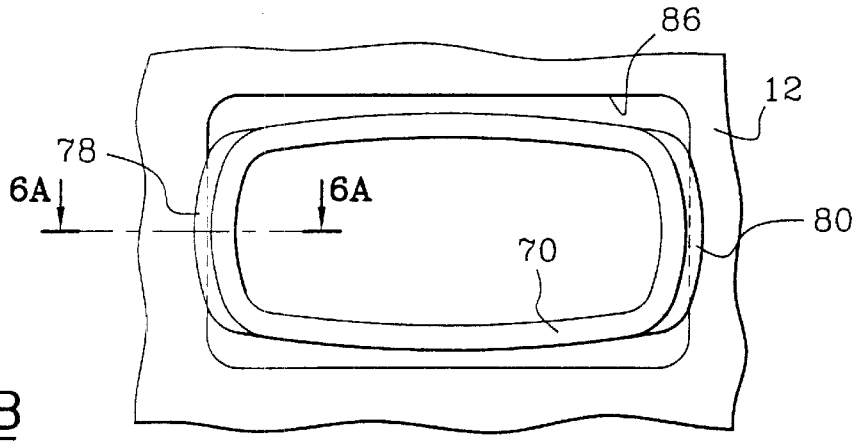
FIG. 6B is a diagram illustrating in front view the ring in the fitted position.

The compression at the ramps also produces a radial widening of the sides of the ring 70 as can be clearly seen in FIG. 5B.

In order for the cover 48 to occupy the fitted position, all that is required is to continue the inward axial movement from the intermediate position. The ring 70 then automatically returns to its initial shape, bringing about the elastic push-fitting of the cover 48 into the opening 46.

When the cover 48 is in the fitted position, the ring 70 is pressing transversely against the edge 86 of the opening 46 via the portions 88 at the radial extremities of its peripheral lateral face 90, and it is pressing axially against the inner face 16 of the panel 12 via its axial-limit surfaces 82. The cover 48 is pressing axially against the outer face 20 of the panel 12 via its annular peripheral wall 50.

Because of its axial-limit surfaces 82, the ring 70 retains the cover 48 axially in the opening 46 of the bodywork panel 12.

It will be observed that the dimensions of the ring 70 and of the opening 46 are selected so that the ring 70 is inscribed within the envelope of the opening 46 when the ring is deformed by the fitting operation. Also, the ring 70 must be long enough axially for the axial-limit surfaces 82 of its radial extremities to be next to the inner face 16 of the bodywork panel 12, in the fitted position.

In the preferred embodiment of the invention depicted here, the opening 46 is of generally rectangular shape. However, in alternative versions (not shown) of the invention, the opening 46 may be of any other shape but will allow the ring 70 to be inscribed within its envelope and to press axially against the inner face 16 of the panel 12.

In the preferred embodiment of the invention, in order to facilitate the fitting of the cover 48 in the opening 46 by means of the ring 70, the ring 70 is fitted onto the tubular skirt 52 with radial clearance so as to facilitate its elastic deformation and its return to its initial shape.

The ring 70 is preferably made of a natural or synthetic elastomeric material.

In the preferred embodiment of the invention, a peripheral seal 92 is interposed axially between the cover 48 and the sensor 42. This seal is then pressed axially in the outward direction against the outward transverse face 54 of the tubular skirt 52, and presses the axial-limit surfaces 82 firmly against the inner face 16 of the panel 12.

In an alternative embodiment (not shown) of the invention, the ring 70 is mounted on the tubular skirt by any other known means, such as adhesive bonding or crimping.

What is claimed is:

1. Security system (10) for an opening leaf of a motor vehicle, in which the opening leaf is held in the closed position by a lock which is operated by means of a handle arranged on the outer face (20) of a bodywork panel (12) of the opening leaf, in which the security system (10) comprises means (40) for detecting the presence of a user's hand near the handle that comprise:

a sensor (42) capable of emitting or receiving an electromagnetic signal; and a module (44) that supports the sensor (42) and that is located on the inner face (16) of the bodywork panel (12) in such a way that the sensor (42) faces an opening (46) made in the bodywork panel (12), in which the opening (46) in the bodywork panel (12) is blanked off by a cover (48) that is made of a material transparent to the signal, and in which the cover (48) comprises an annular outer peripheral wall (50) pressed axially against the outer face (20) of the bodywork panel (12), and a tubular skirt (52) that extends inward axially from the outer peripheral wall (50), through the opening (46) in the bodywork panel (12), wherein the cover (48) is retained axially on the bodywork panel (12) and in the opening (46) of the bodywork panel (12) by means of an elastically deformable inner ring (70) that is mounted on the tubular skirt (52) by elastic push-fitting and enables the cover (48) to be fitted axially from the outside in by elastic push-fitting.

2. Security system (10) according to claim 1, characterized in that the ring (70) comprises, on its inward transverse face (72), at least one surface (78, 80) forming a ramp to bring about its radial deformation by acting on the edge (86) of the opening (46), when the cover (48) is being fitted into the opening (46), and in that the ring (70) comprises an outward transverse face (76) that defines an axial-limit surface (82), which faces the inner face (16) of the bodywork panel (12) when the cover (48) is in the fitted position in the opening (46).

3. Security system (10) according to claim 1, characterized in that the tubular skirt (52) comprises on its inward transverse face (54) at least one surface (56, 58) forming a ramp to bring about the radial deformation of the ring (70) by acting on the edge of the outward transverse face (76) of the ring (70), and in that the tubular skirt (52) comprises an outward transverse face (60) that defines an axial-limit surface (62), which faces the inward transverse face (72) of the ring (70) when the ring (70) is in the fitted position on the tubular skirt (52).

4. Security system (10) according to claim 3, characterized in that each of the ring (70) and the tubular skirt (52) comprises a ramp on each of the portions at the radial extremities of its inward transverse face (72, 54).

5. Security system (10) according to claim 4, characterized in that each of the ring (70) and the tubular skirt (52) comprises an axial-limit surface on each of the portions at the radial extremities, and/or on each of the sides, of its outward transverse face (76, 60).

6. Security system (10) according to claim 1, characterized in that the ring (70) comprises, on its inward transverse face (72), at least one retaining tab (74) that extends inward axially, and in that the tubular skirt (52) comprises at least two stop studs (64) that project from its peripheral lateral face (66) and that sit either side of the retaining tab (74) in order to index the ring (70) in angular terms relative to the tubular skirt (52).

7. Security system (10) according to claim 1, characterized in that the stop studs (64) comprise a surface (68) forming a ramp to bring about the radial deformation of the ring (70) by acting on the edge of the outward transverse face (76) of the ring (70).

8. Security system (10) according to claim 1, characterized in that the ring (70) is made of a natural or synthetic elastomeric material.

9. Security system (10) according to claim 1, characterized in that a peripheral seal (92), which is compressed axially when fitted, exerts an outward axial bearing force on the inward transverse face (54) of the tubular skirt (52).

* * * * *